US008876524B2

(12) United States Patent
Schultz et al.

(10) Patent No.: US 8,876,524 B2
(45) Date of Patent: Nov. 4, 2014

(54) FURNACE WITH MODULATING FIRING RATE ADAPTATION

(75) Inventors: Michael William Schultz, Elk River, MN (US); Jonathan McDonald, Bloomington, MN (US); Victor J. Cueva, New Hope, MN (US)

(73) Assignee: Honeywell International Inc., Morristown, NJ (US)

( * ) Notice: Subject to any disclaimer, the term of this patent is extended or adjusted under 35 U.S.C. 154(b) by 120 days.

(21) Appl. No.: 13/411,022

(22) Filed: Mar. 2, 2012

(65) Prior Publication Data

US 2013/0230812 A1 Sep. 5, 2013

(51) Int. Cl.
*F23N 1/02* (2006.01)

(52) U.S. Cl.
USPC ..... 431/12; 431/11; 126/116 A; 236/11

(58) Field of Classification Search
USPC ..... 431/12; 236/11; 126/116 A
See application file for complete search history.

(56) References Cited

U.S. PATENT DOCUMENTS

| | | | |
|---|---|---|---|
| 3,650,262 | A | 3/1972 | Root et al. |
| 3,967,614 | A | 7/1976 | Stroud |
| 3,999,934 | A | 12/1976 | Chambers et al. |
| 4,192,641 | A | 3/1980 | Nakagawa et al. |
| 4,238,185 | A | 12/1980 | Watson |
| 4,251,025 | A | 2/1981 | Bonne et al. |
| 4,295,606 | A | 10/1981 | Swenson |
| 4,314,441 | A | 2/1982 | Yannone et al. |
| 4,329,138 | A | 5/1982 | Riordan |
| 4,334,855 | A | 6/1982 | Nelson |
| 4,340,355 | A | 7/1982 | Nelson et al. |
| 4,373,897 | A | 2/1983 | Torborg |
| 4,403,599 | A | 9/1983 | Copenhaver |
| 4,439,139 | A | 3/1984 | Nelson et al. |
| 4,445,638 | A | 5/1984 | Connell et al. |
| 4,468,192 | A | 8/1984 | Jaeger et al. |
| 4,483,672 | A | 11/1984 | Wallace et al. |

(Continued)

FOREIGN PATENT DOCUMENTS

| | | |
|---|---|---|
| GB | 1597220 | 9/1981 |
| JP | 63263318 | 10/1988 |

(Continued)

OTHER PUBLICATIONS

Lennox, "G61MPV Series Units," Installation Instructions, 2 pages, Oct. 2006.

(Continued)

*Primary Examiner* — Kenneth Rinehart
*Assistant Examiner* — Gajanan M Prabhu
(74) *Attorney, Agent, or Firm* — Seager Tufte & Wickhem LLC.

(57) ABSTRACT

A furnace is disclosed that includes a burner with a firing rate that is variable between a minimum and a maximum firing rate. After a call for heat is received, the firing rate is set to an initial level above the minimum firing rate, and the burner is ignited. The firing rate is then modulated downward toward the minimum firing rate. If the flame is lost during or after modulation, the burner is reignited and the firing rate is maintained above the firing rate at which the flame was lost until the current call for heat is satisfied. In some cases, the firing rate is maintained until one or more subsequent calls for heat are satisfied.

16 Claims, 3 Drawing Sheets

(56) References Cited

U.S. PATENT DOCUMENTS

| | | | | |
|---|---|---|---|---|
| 4,502,625 | A | 3/1985 | Mueller | |
| 4,533,315 | A | 8/1985 | Nelson | |
| 4,547,144 | A | 10/1985 | Dietiker et al. | |
| 4,547,150 | A | 10/1985 | Vereecke | |
| 4,583,936 | A | 4/1986 | Kriegger | |
| 4,588,372 | A | 5/1986 | Torborg | |
| 4,607,787 | A | 8/1986 | Rogers, III | |
| 4,645,450 | A | 2/1987 | West | |
| 4,648,551 | A | 3/1987 | Thompson et al. | |
| 4,676,734 | A | 6/1987 | Foley | |
| 4,677,357 | A | 6/1987 | Spence et al. | |
| 4,684,060 | A | 8/1987 | Adams et al. | |
| 4,688,547 | A | 8/1987 | Ballard et al. | |
| 4,703,747 | A | 11/1987 | Thompson et al. | |
| 4,703,795 | A | 11/1987 | Beckey | |
| 4,706,881 | A | 11/1987 | Ballard | |
| 4,707,646 | A | 11/1987 | Thompson et al. | |
| 4,708,636 | A | 11/1987 | Johnson | |
| 4,729,207 | A | 3/1988 | Dempsey et al. | |
| 4,767,104 | A | 8/1988 | Plesinger | |
| 4,787,554 | A | 11/1988 | Bartels et al. | |
| 4,819,587 | A | 4/1989 | Tsutsui et al. | |
| 4,830,600 | A | 5/1989 | Vershaw et al. | |
| 4,892,245 | A | 1/1990 | Dunaway et al. | |
| 4,915,615 | A | 4/1990 | Kawamura et al. | |
| 4,976,459 | A | 12/1990 | Lynch | |
| 4,982,721 | A | 1/1991 | Lynch | |
| 4,994,959 | A | 2/1991 | Ovenden et al. | |
| 5,001,640 | A | 3/1991 | Matsumoto et al. | |
| 5,020,771 | A | 6/1991 | Nakatsukasa et al. | |
| 5,026,270 | A | 6/1991 | Adams et al. | |
| 5,027,789 | A | 7/1991 | Lynch | |
| 5,037,291 | A | 8/1991 | Clark | |
| 5,083,546 | A | 1/1992 | Detweiler et al. | |
| 5,112,217 | A | 5/1992 | Ripka et al. | |
| 5,123,080 | A | 6/1992 | Gillett et al. | |
| 5,197,664 | A | 3/1993 | Lynch | |
| 5,206,566 | A | 4/1993 | Yoshida et al. | |
| 5,215,115 | A | 6/1993 | Dietiker | |
| 5,248,083 | A | 9/1993 | Adams et al. | |
| 5,307,990 | A | 5/1994 | Adams et al. | |
| 5,331,944 | A | 7/1994 | Kujawa et al. | |
| 5,340,028 | A | 8/1994 | Thompson | |
| 5,347,981 | A | 9/1994 | Southern et al. | |
| 5,395,230 | A | 3/1995 | Ferguson et al. | |
| 5,408,986 | A | 4/1995 | Bigham | |
| 5,485,953 | A | 1/1996 | Bassett et al. | |
| 5,520,533 | A | 5/1996 | Vrolijk | |
| 5,557,182 | A | 9/1996 | Hollenbeck et al. | |
| 5,590,642 | A | 1/1997 | Borgeson et al. | |
| 5,601,071 | A | 2/1997 | Carr et al. | |
| 5,630,408 | A | 5/1997 | Versluis | |
| 5,634,786 | A | 6/1997 | Tilander | |
| 5,644,068 | A | 7/1997 | Okamoto et al. | |
| 5,682,826 | A | 11/1997 | Hollenbeck | |
| 5,720,231 | A | 2/1998 | Rowlette et al. | |
| 5,732,691 | A | 3/1998 | Maiello et al. | |
| 5,779,466 | A | 7/1998 | Okamura et al. | |
| 5,791,332 | A | 8/1998 | Thompson et al. | |
| 5,806,440 | A | 9/1998 | Rowlette et al. | |
| 5,819,721 | A | 10/1998 | Carr et al. | |
| 5,860,411 | A | 1/1999 | Thompson et al. | |
| 5,865,611 | A | 2/1999 | Maiello | |
| 5,993,195 | A | 11/1999 | Thompson | |
| 6,000,622 | A | 12/1999 | Tonner et al. | |
| 6,109,255 | A | 8/2000 | Dieckmann et al. | |
| 6,133,699 | A | 10/2000 | Vrionis et al. | |
| 6,254,008 | B1 | 7/2001 | Erickson et al. | |
| 6,257,870 | B1 | 7/2001 | Hugghins et al. | |
| 6,283,115 | B1 * | 9/2001 | Dempsey et al. | 126/110 R |
| 6,321,744 | B1 | 11/2001 | Dempsey et al. | |
| 6,354,327 | B1 | 3/2002 | Mayhew | |
| 6,377,426 | B2 | 4/2002 | Hugghins et al. | |
| 6,504,338 | B1 | 1/2003 | Eichorn | |
| 6,549,871 | B1 | 4/2003 | Mir et al. | |
| 6,571,817 | B1 | 6/2003 | Bohan, Jr. | |
| 6,666,209 | B2 | 12/2003 | Bennett et al. | |
| 6,705,533 | B2 | 3/2004 | Casey et al. | |
| 6,749,423 | B2 | 6/2004 | Fredricks et al. | |
| 6,758,909 | B2 | 7/2004 | Jonnalagadda et al. | |
| 6,764,298 | B2 | 7/2004 | Kim et al. | |
| 6,793,015 | B1 | 9/2004 | Brown et al. | |
| 6,846,514 | B2 | 1/2005 | Jonnalagadda et al. | |
| 6,866,202 | B2 | 3/2005 | Sigafus et al. | |
| 6,880,548 | B2 | 4/2005 | Schultz et al. | |
| 6,918,756 | B2 | 7/2005 | Fredricks et al. | |
| 6,923,643 | B2 | 8/2005 | Schultz et al. | |
| 6,925,999 | B2 | 8/2005 | Hugghins et al. | |
| 7,055,759 | B2 | 6/2006 | Wacker et al. | |
| 7,101,172 | B2 | 9/2006 | Jaeschke | |
| 7,111,503 | B2 | 9/2006 | Brumboiu et al. | |
| 7,241,135 | B2 | 7/2007 | Munsterhuis et al. | |
| 7,293,718 | B2 | 11/2007 | Sigafus et al. | |
| 7,455,238 | B2 | 11/2008 | Hugghins | |
| 7,985,066 | B2 | 7/2011 | Chian et al. | |
| 8,070,481 | B2 | 12/2011 | Chian et al. | |
| 8,123,518 | B2 | 2/2012 | Nordberg et al. | |
| 2002/0155405 | A1 | 10/2002 | Casey et al. | |
| 2004/0079354 | A1 | 4/2004 | Takeda | |
| 2007/0221276 | A1 | 9/2007 | Buezis et al. | |
| 2008/0127963 | A1 | 6/2008 | Thompson | |
| 2009/0044794 | A1 | 2/2009 | Hugghins et al. | |
| 2009/0092937 | A1 * | 4/2009 | Crnkovich et al. | 431/75 |
| 2009/0297997 | A1 * | 12/2009 | Chian et al. | 431/12 |
| 2009/0308372 | A1 | 12/2009 | Nordberg et al. | |
| 2010/0112500 | A1 * | 5/2010 | Maiello et al. | 431/76 |
| 2011/0100349 | A1 | 5/2011 | Hugghins | |
| 2011/0111352 | A1 | 5/2011 | Hugghins | |
| 2012/0130542 | A1 | 5/2012 | Nordberg et al. | |

FOREIGN PATENT DOCUMENTS

| | | |
|---|---|---|
| JP | 63263319 | 10/1988 |
| JP | 06174381 | 6/1994 |
| JP | 07233936 | 9/1995 |

OTHER PUBLICATIONS

Honeywell, "45.801.175, Amplification Gas/Air Module for VK4105R/VK8105R Gas Controls," Production Handbook, 8 pages, prior to Oct. 18, 2006.

Honeywell, "VK41..R/VK81..R Series, Gas Controls with Integrated Gas/Air Module for Combined Valve and Ignition System," Instruction Sheet, 6 pages, prior to Oct. 18, 2006.

http://www.regal-beloit.com/gedraft.html, "Welcome to GE Commercial Motors by Regal-Beloit," 1 page, printed Apr. 26, 2006.

"Adjustment Instructions & Wiring Diagrams for Solid State Blower Motor Speed Control," Honeywell Solid State Handbooks, 24 pages, prior to Jan. 26, 1994.

"Appendix 7.7 Gas and Electricity Use for Modulating Furnaces," 8 pages, Downloaded Dec. 9, 2007.

"New Imperial Gas Furnace," Rheem Manufacturing Company, 1970.

"Request for Inter Partes Review of U.S. Patent No. 5590642 Under 35 USC §§311-319," 66 pages, Dec. 2012.

"Solid State Breakthrough," Rheem Manufacturing Company, 1969.

American Gas Association, "American National Standard/National Standard of Canada," 3 pages, Downloaded Mar. 1, 2013.

Bassett et al, "Modulating Combustion," 3 pages, Sep. 27, 2001.

Gas Research Institute, "Modulating Furnace andZoned Heating Development," GRI-91/0075, Feldman et al., published Jan. 1991.

Varidigm, "Varidigm GFAC100 Series Gas Forced Air Combustion and Motor Speed Controllers," 2 pages, Downloaded Dec. 11, 2007.

* cited by examiner

FURNACE WITH MODULATING FIRING RATE ADAPTATION

TECHNICAL FIELD

The disclosure relates generally to furnaces, and more particularly, to furnaces that have a modulating firing rate capability.

BACKGROUND

Many homes and other buildings rely upon furnaces to provide heat during cool and/or cold weather. Typically, a furnace employs a burner that burns a fuel such as natural gas, propane, oil or the like, and provides heated combustion gases to the interior of a heat exchanger. The combustion gases typically proceed through the heat exchanger, are collected by a collector box, and then are exhausted outside of the building via a vent or the like. In some cases, a combustion blower is provided to pull combustion air into the burner, pull the combustion gases through the heat exchanger into the collector box, and to push the combustion gases out the vent. To heat the building, a circulating air blower typically forces return air from the building, and in some cases ventilation air from outside of the building, over or through the heat exchanger, thereby heating the air. The heated air is then typically routed throughout the building via a duct system. A return duct system is typically employed to return air from the building to the furnace to be re-heated and then re-circulated.

In order to provide improved fuel efficiency and/or occupant comfort, some furnaces may be considered as having two or more stages, i.e., they have two or more separate heating stages, or they can effectively operate at two or more different burner firing rates, depending on how much heat is needed within the building. Some furnaces are known as modulating furnaces, because they can operate at a number of different firing rates. The firing rate of such furnaces typically dictates the amount of gas and combustion air that is required by the burner. The amount of gas delivered to the burner is typically controlled by a variable gas valve, and the amount to combustion air is often controlled by a combustion blower. To obtain a desired fuel to air ratio for efficient operation of the furnace, the gas valve and the combustion blower speed are typically operate in concert with one another, and in accordance with the desired firing rate of the furnace.

In some cases, when the firing rate is reduced during operation of the furnace, the flame in the furnace can be extinguished. In some cases, the safety features of the furnace itself may extinguish the flame. For example, a dirty flame rod, which may not be able to detect the flame at reduced firing rates, may cause a safety controller of the furnace to extinguish the flame. Likewise, ice buildup or other blockage of the exhaust flue, or even heavy wind condition, may prevent sufficient combustion airflow to be detected, which can cause a safety controller of the furnace to extinguish the flame, particularly at lower firing rates. If the flame goes out, many furnaces will simply return to the burner ignition cycle, and repeat. However, after ignition, the furnace may attempt to return to the lower firing rate, and the flame may again go out. This cycle may continue, sometimes without providing significant heat to the building and/or satisfying a current call for heat. This can lead to occupant discomfort, and in some cases, the freezing of pipes or like in the building, both of which are undesirable.

SUMMARY

This disclosure relates generally to furnaces, and more particularly, to furnaces that have a modulating firing rate capability. In one illustrative embodiment, a furnace has a burner and includes a firing rate that is variable between a minimum and a maximum firing rate. After a call for heat is received, the firing rate is set to an initial level above the minimum firing rate, and the burner is ignited. The firing rate is then modulated downward toward the minimum firing rate. If the flame is lost during or after modulation, the burner is reignited and the firing rate is maintained above the firing rate at which the flame was lost until the current call for heat is satisfied. In some cases, the firing rate is maintained until one or more subsequent calls for heat are satisfied. In some cases, the maintained firing rate is the same as the initial level, but this is not required.

In another illustrative embodiment, a combustion appliance may include a burner that has three or more different firing rates including a minimum firing rate, a maximum firing rate and at least one intermediate firing rate between the minimum firing rate and the maximum firing rate. The combustion appliance may operate in a number of HVAC cycles in response to one or more calls for heat from a thermostat or the like. A current call for heat may be received to initiate a current HVAC cycle. The combustion appliance may be set to a first firing rate. The first firing rate may be above the minimum firing rate. The burner of the combustion appliance may then be ignited. Once the burner is ignited, the firing rate may be modulated from the first firing rate down towards the minimum firing rate. If the flame is lost as the firing rate is modulated down towards the minimum firing rate, the combustion appliance may be set to a second firing rate, where the second firing rate is above the firing rate at which the flame was lost, and the burner of the combustion appliance may be re-ignited. Once re-ignited, the combustion appliance may be maintained at a third firing rate that is above the firing rate at which the flame was lost until the current call for heat is satisfied or substantially satisfied.

Another illustrative embodiment may be found in controller for a modulating combustion appliance having a burner and a variable firing rate that can be varied between a minimum firing rate and a maximum firing rate. The controller may include an input for receiving a call for heat. The controller may also include a first output for setting the firing rate of the modulating combustion appliance, and a second output for commanding an igniter to ignite the burner. The controller may be configured to receive a current call for heat via the input, and once received, to set the combustion appliance to a burner ignition firing rate via the first output. The burner ignition firing rate may be above the minimum firing rate. The controller may be configured to ignite the burner of the combustion appliance by sending a command to the igniter via the second output. The controller may then be configured to modulate the firing rate from the burner ignition firing rate down towards the minimum firing rate. The controller may determine if flame is lost as the firing rate is modulated down towards the minimum firing rate. If flame was lost, the controller may in some cases reset the firing rate to the burner ignition firing rate via the first output, and reignite the burner by sending a command to the igniter via the second output. The controller may then be configured to maintain the firing rate of the combustion appliance above the firing rate at which the flame was lost, sometimes at least until the current call for heat is satisfied.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION

The disclosure may be more completely understood in consideration of the following description of various embodiments in connection with the accompanying drawings, in which.

Figure 1:
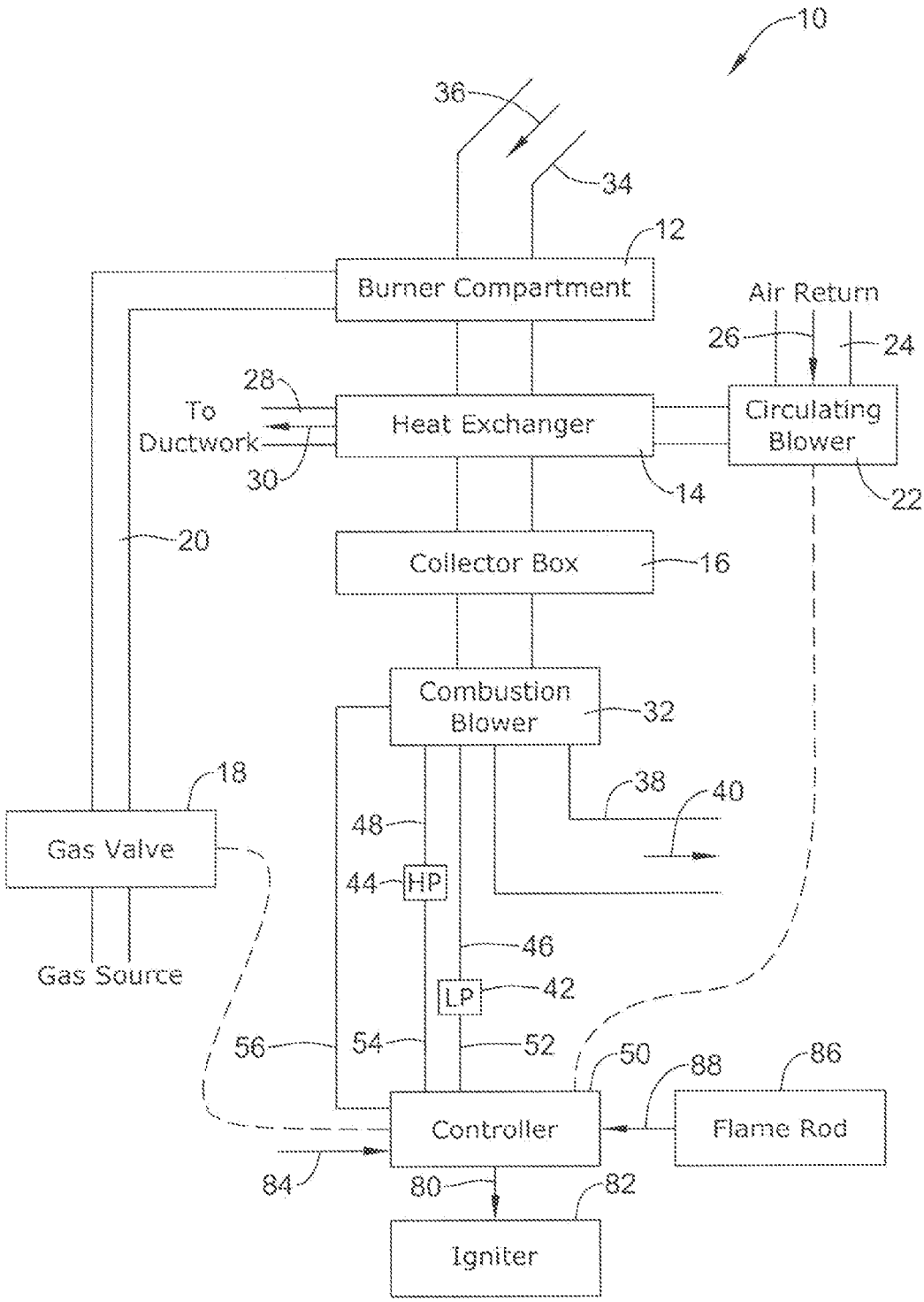
FIG. 1 is a schematic view of an illustrative but non-limiting furnace.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several embodiments which are meant to illustrative in nature.

FIG. 1 is a schematic view of an illustrative furnace 10, which may include additional or other components not described herein. The primary components of illustrative furnace 10 include a burner compartment 12, a heat exchanger 14 and a collector box 16. A gas valve 18 may provide fuel such as natural gas or propane, from a source (not illustrated) to burner compartment 12 via a gas line 20. Burner compartment 12 burns the fuel provided by gas valve 18, and provides heated combustion products to heat exchanger 14. The heated combustion products pass through heat exchanger 14 and exit into collector box 16, and are ultimately exhausted to the exterior of the building or home in which furnace 10 is installed.

In the illustrative furnace, a circulating blower 22 may accepts return air from the building or home's return ductwork 24, as indicated by arrow 26, and blows the return air through heat exchanger 14, thereby heating the air. The heated air may exit heat exchanger 14 and enters the building or home's conditioned air ductwork 28, traveling in a direction indicated by arrow 30. For enhanced thermal transfer and efficiency, the heated combustion products may pass through heat exchanger 14 in a first direction while circulating blower 22 forces air through heat exchanger 14 in a second direction. In some instances, for example, the heated combustion products may pass generally downwardly through heat exchanger 14 while the air blown through by circulating blower 22 may pass upwardly through heat exchanger 14, but this is not required.

In some cases, as illustrated, a combustion blower 32 may be positioned downstream of collector box 16 and may pull combustion gases through heat exchanger 14 and collector box 16. Combustion blower 32 may be considered as pulling combustion air into burner compartment 12 through combustion air source 34 to provide an oxygen source for supporting combustion within burner compartment 12. The combustion air may move in a direction indicated by arrow 36. Combustion products may then pass through heat exchanger 14, into collector box 16, and ultimately may be exhausted through the flue 38 in a direction indicated by arrow 40.

In some cases, the gas valve 18 may be a pneumatic amplified gas/air valve that is pneumatically controlled by pressure signals created by the operation of the combustion blower 32. As such, and in these cases, the combustion blower speed may be directly proportional to the firing rate of the furnace 10. Therefore, an accurate combustion blower speed may be desirable for an accurate firing rate. In other cases, the gas valve 18 may be controlled by a servo or the like, as desired.

In some cases, furnace 10 may include a low pressure switch 42 and a high pressure switch 44, each of which are schematically illustrated in FIG. 1. Low pressure switch 42 may be disposed, for example, in or near combustion blower 32 and/or may be in fluid communication with the flow of combustion gases via a pneumatic line or duct 46. Similarly, high pressure switch 44 may be disposed, for example, in or near combustion blower 32 and/or may be in fluid communication with the flow of combustion gases via a pneumatic line or duct 48. In some cases, low pressure switch 42 may be situated downstream of the burner compartment, and the high pressure switch 44 may be situated upstream of the burner box. It is contemplated that the low pressure switch 42 and the high pressure switch 44 may be placed at any suitable location to detect a pressure drop along the combustion air path, and thus a measure of flow rate through the combustion air path.

As flow through an enclosed space (such as through collector box 16, combustion blower 32 and/or flue 38) increases in velocity, it will be appreciated that the pressure exerted on the high and lower pressure switches will also change. Thus, a pressure switch that has a first state at a lower pressure and a second state at a higher pressure may serve as an indication of flow rate. In some instances, a pressure switch may be open at low pressures but may close at a particular higher pressure. In the example shown, low pressure switch 42 may, in some cases, be open at low pressures but may close at a first predetermined lower pressure. This first predetermined lower pressure may, for example, correspond to a minimum air flow deemed desirable for safe operation at a relatively low firing rate of the furnace. High pressure switch 44 may, in some cases, be open at pressures higher than that necessary to close low pressure switch 42, but may close at a second predetermined higher pressure. This second predetermined higher pressure may, for example, correspond to a minimum air flow deemed desirable for safe operations at a relatively higher firing rate (e.g. max firing rate). In some cases, it is contemplated the low pressure switch 42 and the high pressure switch 44 may be replaced by a differential pressure sensor, and/or a flow sensor, if desired.

As shown in FIG. 1, furnace 10 may include a controller 50 that may, in some instances, be an integrated furnace controller that is configured to communicate with one or more thermostats or the like (not shown) for receiving heat request signals (calls for heat) from various locations within the building or structure. It is contemplated that controller 50 may be configured to provide connectivity to a wide range of platforms and/or standards, as desired.

In some instances, controller 50 may be configured to control various components of furnace 10, including the ignition of fuel by an ignition element (not shown), the speed and operation times of combustion blower 32, and the speed and operation times of circulating fan or blower 22. In addition, controller 50 can be configured to monitor and/or control various other aspects of the system including any damper and/or diverter valves connected to the supply air ducts, any sensors used for detecting temperature and/or airflow, any sensors used for detecting filter capacity, any shut-off valves used for shutting off the supply of gas to gas valve 18, and/or any other suitable equipment. Note that the controller may also be configured to open and close the gas valve 18 and/or control the circulating blower 22.

In the illustrative embodiment shown, controller 50 may, for example, receive electrical signals from low pressure switch 42 and/or high pressure switch 44 via electrical lines 52 and 54, respectively. In some instances, controller 50 may be configured to control the speed of combustion blower 32 via an electrical line 56. Controller 50 may, for example, be programmed to monitor low pressure switch 42 and/or high pressure switch 44, and adjust the speed of combustion blower 32 to help provide safe and efficient operation of the furnace. In some cases, controller 50 may also adjust the speed of combustion blower 32 for various firing rates, depending on the detected switch points of the low pressure switch 42 and/or high pressure switch 44.

In some instances, it may be useful to use different firing rates in the furnace 10. For instance, after a call for heat is received, it may be less efficient and/or may result in less comfort to run the furnace at a constant firing rate until the call for heat is satisfied. As such, and in some cases, it may be advantageous to modulate (i.e. vary) the firing rate of the furnace 10 while satisfying a call for heat. In some cases, the furnace 10 may have a minimum firing rate, a maximum firing rate, and at least one intermediate firing rate between the minimum and maximum firing rates.

A typical approach for a modulating furnace is to first modulate the firing rate down to a minimum firing rate, then modulating up to higher firing rate throughout a call for heat, getting closer and closer to a maximum firing rate in an attempt to satisfy the call for heat. The approach shown in FIG. 2 differs slightly from this typical approach.

Figure 2:
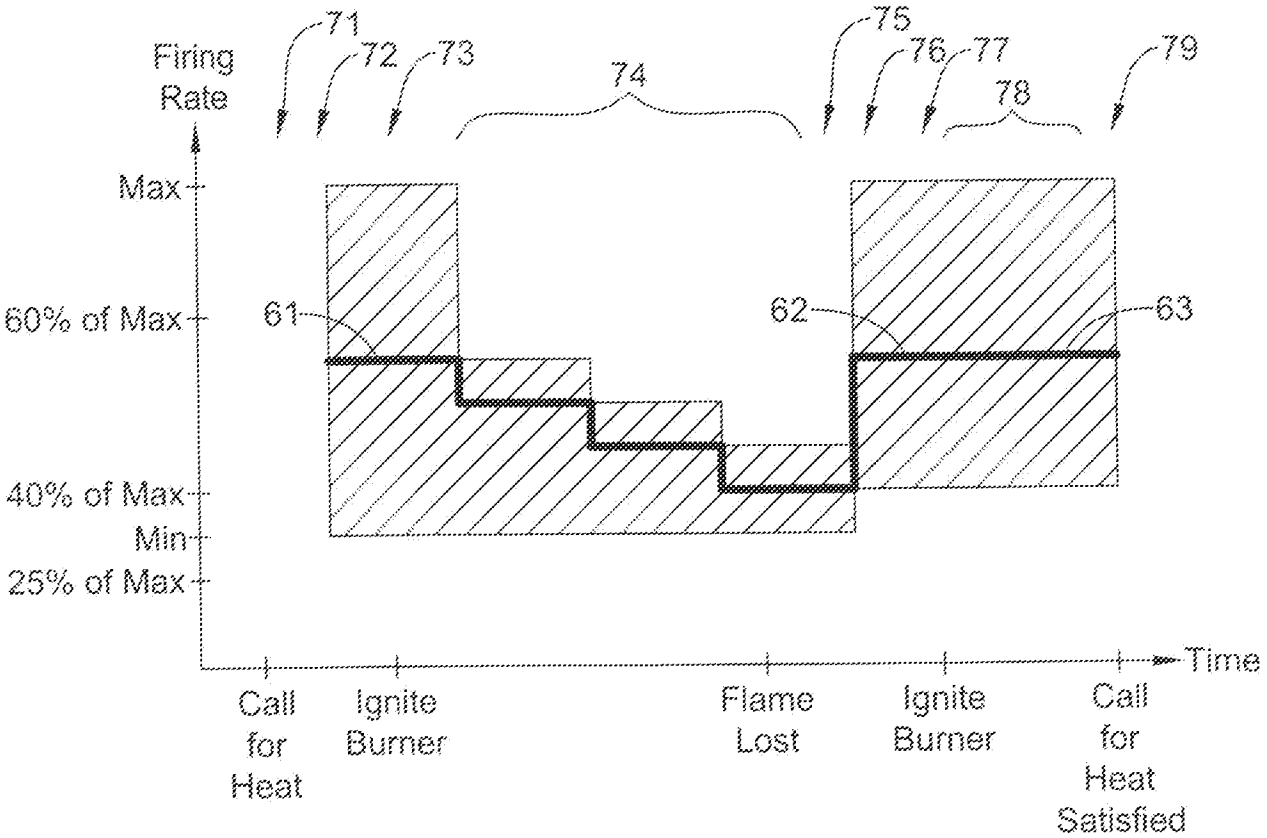
FIG. 2 is a plot of an illustrative but non-limiting firing rate sequence versus time for an HVAC cycle of the furnace of FIG. 1.

FIG. 2 is a plot of an illustrative but non-limiting firing rate sequence versus time for an HVAC cycle of the furnace 10 of FIG. 1. The firing rates are shown in terms of a maximum firing rate (MAX), a minimum firing rate (MIN), and percentages of the maximum firing rate (60% of MAX, 40% of MAX, and so forth).

In the example shown in FIG. 2, the minimum firing rate (MIN) is in the range of 25% to 40% of the maximum firing rate (MAX). In other cases, the minimum firing rate (MIN) may be less than 25% of the maximum firing rate (MAX). In still other cases, the minimum firing rate (MIN) may be greater than 40% of the maximum firing rate (MAX).

Time intervals and specific times are denoted in FIG. 2 by elements numbered 71 through 79. At time 71, a call for heat is received by the furnace 10 or by the appropriate element (e.g. controller 50) of the furnace 10. Because the furnace 10 operates by sequential cycles of receiving and satisfying calls for heat, the particular call for heat initiated at time 71 may be referred to as a current call for heat. This current call for heat may initiate a current HVAC cycle, which includes all of time intervals numbered 71 through 79. Preceding and subsequent HVAC cycles may have similar characteristics to the example shown in FIG. 2.

Once the current call for heat is received, the furnace 10 may be set at time 72 to a first firing rate 61. The delay between when the current call for heat is received and when the first firing rate 61 is set may be arbitrarily small, such as on the order of a fraction of a second, a second, or a few seconds, or may include a predetermined time interval, such as 15 seconds, 30 seconds, or a minute. In some cases, the time 72 at which the first firing rate 61 is set may occur at one of a series of predetermined clock times, when a call for heat status is periodically polled. In general, it should be noted that any or all of the times shown in FIG. 2 may optionally occur at one of a series of discrete polling times, or at any other suitable time, as desired.

The first firing rate 61 is shown as above the minimum firing rate (MIN). The first firing rate 61 is also shown to be below the maximum firing rate (MAX), but this is not required. For example, in some cases, the first firing rate 61 may be the maximum firing rate (MAX). The first firing rate may be referred to as a burner ignition firing rate. Once the firing rate is set at time 72 to the first firing rate 61, the burner may be ignited at time 73. Once the burner has been ignited at time 73, the firing rate may be modulated downward toward the minimum firing rate (MIN). This modulation is shown in time interval 74. While the firing rate is shown to be modulated downward in discrete steps, it is contemplated that the firing rate may be modulated downward continuously, or in any other suitable manner. As the firing rate is decreased in time interval 74, the furnace 10 may check to see if the flame has been lost or if the flame is still present. The flame checking may be periodic or irregular, and may optionally occur with each change in firing rate. The time interval 74 ends with one of two possible events occurring.

In one case, the firing rate reaches the minimum firing rate (MIN) while the flame is maintained. For this case, the firing rate continues after time interval 74 at the minimum firing rate (MIN) until the current call for heat is satisfied. This case is not explicitly shown in FIG. 2. In the other case, the firing rate decreases to a level at or above the minimum firing rate (MIN), where the flame checking determines at time 75 that the flame has been lost. This is the case shown in FIG. 2 and discussed in more detail below. In some cases, determination that the flame has been lost produces an error on a user interface associated with the furnace 10, but this is not required.

Once it is determined that the flame has been lost, the firing rate may be set at time 76 to a second firing rate 62. The second firing rate 62 may be above the firing rate at which the flame was lost, and may be at or below the maximum firing rate (MAX). In some cases, such as in the example shown in FIG. 2, the second firing rate 62 is the same as the first firing rate 61. In some cases, the first firing rate 61 and the second firing rate 62 both correspond to an ignition firing rate. In some cases, the ignition firing rate is between 40% and 100% of the maximum firing rate (MAX), but this is not required.

Once the firing rate is set to the second firing rate 62 at time 76, the burner may be ignited at time 77. Once the burner is ignited at time 77, the firing rate may be maintained at a third firing rate 63 for time interval 78. In some cases, such as in the example shown in FIG. 2, the third firing rate 63 is the same as the second firing rate 62, but this is not required. For example, the third firing rate 63 may be set anywhere between the firing rate at which flame was lost and the maximum firing rate (MAX), if desired. The time interval 78 ends at time 79, which correspond to the time that the current call for heat is satisfied or is substantially satisfied.

In some cases, the third firing rate 63 is maintained for the current HVAC cycle, shown as interval 78 in FIG. 2, and is maintained for one or more subsequent HVAC cycles (i.e. one or more subsequent calls for heat) of the furnace 10. In such an instance, if the flame is lost, as is shown at time 75, the firing rate may be maintained above the firing rate at which the flame was lost until the current call for heat is satisfied and/or until one or more subsequent calls for heat are satisfied.

For the example shown in FIG. 2, the first 61, second 62 and third 63 firing rates are all the same. Other configurations are contemplated, with differing firing rates that may be at other levels, such as within the cross-hatched regions shown in FIG. 2. For example, the third firing rate 63 may, in some instances, differ from the second firing rate 62, and may have a value between, for example, 40% and 60% of the maximum firing rate (MAX). If one were to plot such a case, the minimum and maximum cross-hatched regions for the third firing rate 63 in time interval 78 would extend from 40% to 60% of MAX, rather than the values shown in FIG. 2. As another example, the third firing rate 63 may correspond to a last firing rate detected before the flame was determined to have been lost, or an offset from the last firing rate, if desired.

The HVAC cycle shown in FIG. 2 may be implemented by the controller 50 of the furnace shown in FIG. 1. The controller 50 may have an input 84 for receiving a call for heat from a thermostat or the like, an output 56 for setting the firing rate of the furnace, and an output 80 for commanding an igniter 82 to ignite a burner in the burner compartment 12. The controller 50 may be configured to receive a current call for heat via the input 84, set the firing rate to an ignition firing rate above the minimum firing rate (MIN) via output 56, ignite the burner via output 80, modulate the firing rate down toward the minimum firing rate (MIN) via output 56, determine if the flame is lost via an input signal 88 from a flame rod 86 or the like, and if the flame was lost, reignite the burner via output 80 and maintain the firing rate above the firing rate at which the flame was lost.

In some cases, the controller 50 may maintain the firing rate above the firing rate at which the flame was lost until the current call for heat is satisfied. In some cases, the controller 50 may maintain the firing rate above the firing rate at which the flame was lost until the current call for heat is satisfied and until one or more subsequent calls for heat are satisfied. In some cases, the controller 50 may initiate a calibration cycle after the current call for heat is satisfied, or after one or more subsequent calls for heat are satisfied.

While FIG. 2 shows the firing rates 61, 62, 63 as a function of time for an HVAC cycle, the furnace 10 may also include a calibration cycle or cycles that can run before and/or after the HVAC cycle. In some cases, the calibration cycle is initiated after the current HVAC cycle is completed but before a subsequent HVAC cycle is initiated. In other cases, the calibration cycle may be initiated after the current HVAC cycle is completed and one or more subsequent HVAC cycles are also completed. In some cases, the calibration cycle is initiated when flame is lost during an HVAC cycle, but is not initiated if flame is not lost.

Figure 3:
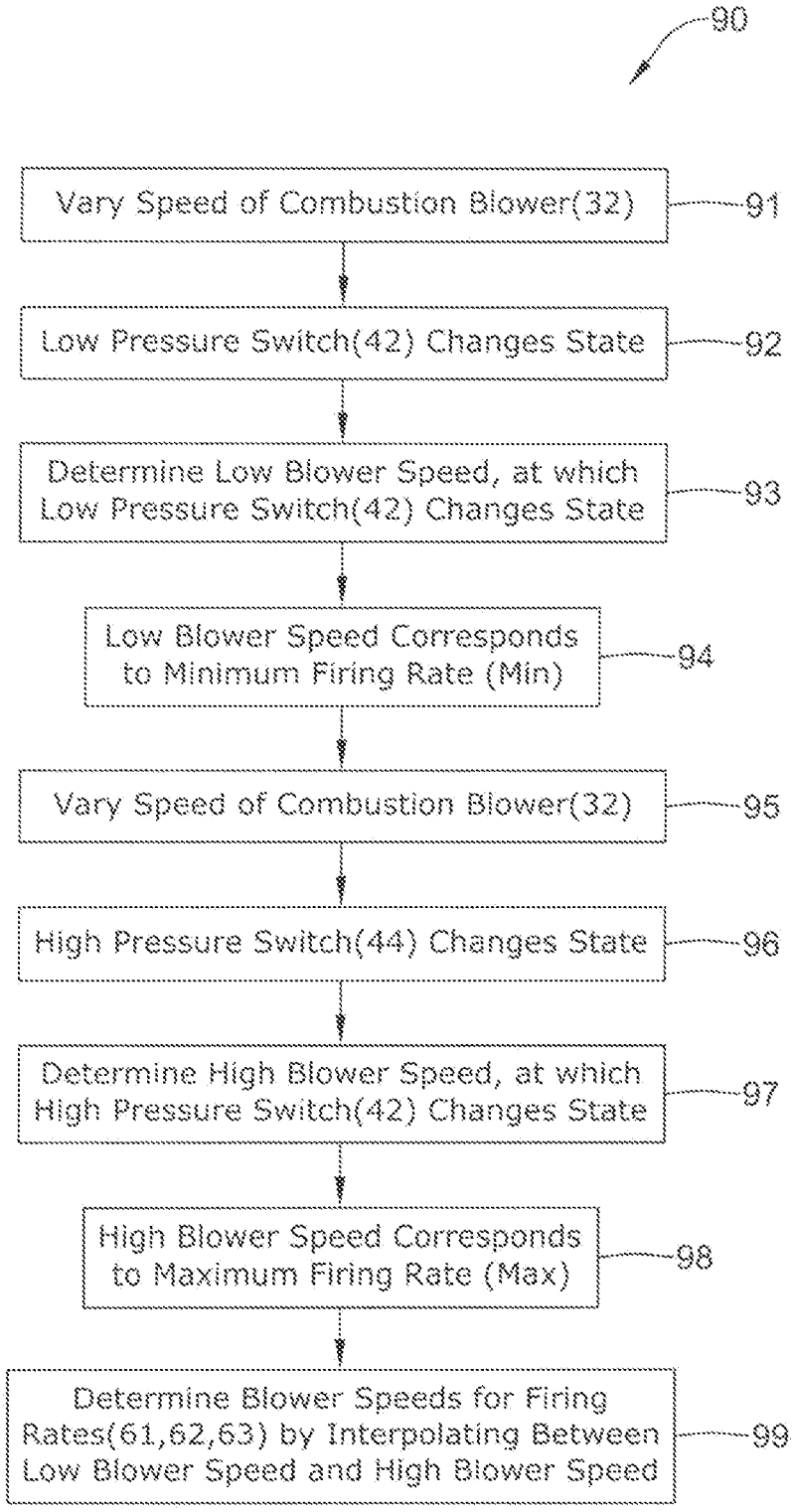
FIG. 3 is a flow diagram for an illustrative but non-limiting calibration method that may be carried out by the furnace of FIG. 1.

FIG. 3 is a flow diagram for an illustrative but non-limiting calibration cycle 90. In element 91, the speed of the combustion blower 32 is increased from a low speed. The speed may be increased continuously or in discrete steps, as needed. The speed may be increased until the low pressure switch 42 changes state, as shown in element 92. In element 93, a low blower speed is determined, at which the low pressure switch 42 changes state. To determine such a blower speed, elements 91 and 92 may be repeated as needed. For example, the blower speed may be increased until the low pressure switch 42 closes, then reduced until the low pressure switch 42 opens, and then increased until the low pressure switch 42 closes again. This may help identify and compensate for any hysteresis that might be associated with the low pressure switch 42. In any event, in element 94, the low blower speed from element 93 may correspond to the minimum firing rate (MIN) shown in FIG. 2.

In element 95, the speed of the combustion blower 32 is further increased. The speed may be increased continuously or in discrete steps, as needed. The speed is increased until the high pressure switch 44 changes state, as shown at element 96. In element 97, a high blower speed is determined, at which the high pressure switch 44 changes state. To determine such a blower speed, elements 95 and 96 may be repeated as needed. For example, the blower speed may be increased until the high pressure switch 44 closes, then reduced until the high pressure switch 44 opens, and then increased until the high pressure switch 44 closes again. This may help identify and compensate for any hysteresis that might be associated with the high pressure switch 44. In any event, in element 98, the high blower speed from element 97 may correspond to the maximum firing rate (MAX) shown in FIG. 2.

In some cases, elements 91 through 94 and 95 through 98 may be performed in concert, with the combustion blower speed varying over a relatively large range, with both pressure switches changing state within the range. In other cases, elements 95 through 98 may be performed before or separately from elements 91 through 94, as desired.

It will be appreciated that although in the illustrated example the pressure switches are configured to be open at lower pressures and to close at a particular higher pressure, in some cases one or both of the pressure switches could instead be configured to be closed at lower pressures and to open at a particular higher pressure. Moreover, it will be appreciated that controller 50 could start at a higher blower speed and then decrease the blower speed until the first and/or second pressure switches change state, if desired.

In element 99, blower speeds corresponding to the firing rates 61, 62, 63 are determined by interpolating between the low blower speed and the high blower speed identified above. In some case, controller 50 (FIG. 1) may carry out a linear interpolation that permits controller 50 to determine an appropriate combustion blower speed for any desired firing rate. Also, the gas valve 18 may be a pneumatic amplified gas/air valve that is pneumatically controlled by pressure signals created by the operation of the combustion blower 32. As such, and in these cases, the combustion blower speed may be directly proportional to the firing rate of the furnace 10.

A variety of different interpolation and/or extrapolation techniques are contemplated. In some cases, controller 50 (FIG. 1) may perform a simple linear interpolation between the minimum firing rate and the maximum firing rate, as described above. In some instances, controller 50 may perform an interpolation that results in a non-linear relationship between minimum firing rate and the maximum firing rate. Depending, for example, on the operating dynamics of furnace 10 and/or the specifics of gas valve 18 and/or combustion blower 32, controller 50 may perform an interpolation that has any suitable relationship between, for example, firing rate and combustion blower speed. It is contemplated that the relationship may be a logarithmic relationship, a polynomial relationship, a power relationship, an exponential relationship, a piecewise linear relationship, a moving average relationship, or any other suitable relationship as desired.

Note that there may be occasions when the flame is lost or never quite established at the initial ignition rate. In terms of FIG. 2, this corresponds to the flame being lost or not establishing at first firing rate 61, at the leftmost edge of the figure. For these cases, if the first firing rate 61 is not at the maximum firing rate (MAX), then the firing rate may be modulated upward toward the maximum firing rate (MAX) until the flame is established. For those cases, the furnace may not allow modulation below that threshold rate.

Having thus described several illustrative embodiments of the present disclosure, those of skill in the art will readily appreciate that yet other embodiments may be made and used within the scope of the claims hereto attached. It will be understood, however, that this disclosure is, in many respect, only illustrative. Changes may be made in details, particularly in matters of shape, size, arrangement of parts, and exclusion and order of steps, without exceeding the scope of the disclosure. The disclosure's scope is, of course, defined in the language in which the appended claims are expressed.

What is claimed is:

1. A method of operating a combustion appliance that has a burner, a variable speed combustion blower, three or more different firing rates including a minimum firing rate, a maximum firing rate and at least one intermediate firing rate between the minimum firing rate and the maximum firing rate, wherein each of the three or more firing rates have a different corresponding combustion blower speed, the combustion appliance further including a first pressure switch and a second pressure switch, the combustion appliance operating in a number of HVAC cycles in response to one or more calls for heat, the method comprising:

receiving a current call for heat to initiate a current HVAC cycle;

setting the combustion appliance to a first firing rate, wherein the first firing rate is above the minimum firing rate;

igniting the burner of the combustion appliance;

once ignited, modulating the firing rate from the first firing rate down towards the minimum firing rate;

determining if flame is lost as the firing rate is modulated down towards the minimum firing rate or after the firing rate has been modulated down toward the minimum firing rate, and wherein if flame is lost:

setting the combustion appliance to a second firing rate, wherein the second firing rate is above the firing rate at which the flame was lost;

igniting the burner of the combustion appliance;

maintaining the combustion appliance at a third firing rate that is above the firing rate at which the flame was lost until the current call for heat is satisfied or substantially satisfied; and initiating a calibration cycle subsequent to the current HVAC cycle to identify an updated minimum firing rate, the calibration cycle comprising changing the blower speed of the variable speed combustion blower until the first pressure switch changes state, determining a first blower speed that is related to when the first pressure switch changes state, the first blower speed corresponding to the updated minimum firing rate of the combustion appliance, changing the blower speed of the variable speed combustion blower until the second pressure switch changes state, and determining a second blower speed that is related to when the second pressure switch changes state, the second blower speed corresponding to an updated maximum firing rate of the combustion appliance.

2. The method of claim 1, wherein the first firing rate and the second firing rate are the same firing rate.

3. The method of claim 1, wherein the first firing rate and the second firing rate both correspond to an ignition firing rate.

4. The method of claim 3, wherein the ignition firing rate is in a range of 40-100% of the maximum firing rate of the combustion appliance.

5. The method of claim 1, wherein the minimum firing rate is in a range of 25-40% of the maximum firing rate of the combustion appliance.

6. The method of claim 1, wherein the third firing rate is the same as the second firing rate.

7. The method of claim 1, wherein the third firing rate is in a range of 40-60% of the maximum firing rate of the combustion appliance.

8. The method of claim 1, wherein the third firing rate corresponds to a last firing rate detected before flame was determined to have been lost.

9. The method of claim 1, wherein the third firing rate is maintained for the current HVAC cycle and one or more subsequent HVAC cycles of the combustion appliance.

10. The method of claim 1, further comprising indicating an error on a user interface that is associated with the combustion appliance if the determining step determines that flame was lost.

11. The method of claim 1, wherein the calibration cycle is initiated after the current HVAC cycle is completed but before a subsequent HVAC cycle is initiated.

12. The method of claim 1, wherein the calibration cycle is initiated after the current HVAC cycle is completed and one or more subsequent HVAC cycle are also completed.

13. A controller for a modulating combustion appliance having a burner and a variable firing rate that can be varied between a minimum firing rate and a maximum firing rate, the controller comprising:

an input for receiving a call for heat;

a first output for setting the firing rate of the modulating combustion appliance;

a second output for commanding an igniter to ignite the burner;

the controller configured to:

receive a current call for heat via the input, and in response;

set the combustion appliance to a burner ignition firing rate via the first output, wherein the burner ignition firing rate is above the minimum firing rate;

ignite the burner of the combustion appliance by sending a command to the igniter via the second output;

once ignited, modulate the firing rate from the burner ignition firing rate down towards the minimum firing rate;

determine if flame is lost when the firing rate is modulated down towards the minimum firing rate;

if flame was lost, reignite the burner by sending a command to the igniter via the second output, and maintain the firing rate of the combustion appliance above the firing rate at which the flame was lost;

receive a subsequent call for heat via the input, and in response;

set the combustion appliance to a burner ignition firing rate via the first output, wherein the burner ignition firing rate is above the minimum firing rate;

ignite the burner of the combustion appliance by sending a command to the igniter via the second output;

once ignited, modulate the firing rate from the burner ignition firing rate down towards the minimum firing rate;

determine if flame is lost when the firing rate is modulated down towards the minimum firing rate; and if flame was lost, reignite the burner by sending a command to the igniter via the second output, and maintain the firing rate of the combustion appliance above the firing rate at which the flame was lost.

14. The controller of claim 13, wherein if flame was lost, the controller is configured to maintain the firing rate of the combustion appliance above the firing rate at which the flame was lost until the call for heat is satisfied.

15. The controller of claim 14, wherein if flame was lost, the controller is configured to maintain the firing rate of the combustion appliance above the firing rate at which the flame was lost until the current call for heat is satisfied and until one or more subsequent calls for heat are satisfied.

16. The controller of claim 13, wherein the controller is further configured to initiate a calibration cycle after the call for heat is satisfied.

* * * * *